United States Patent [19]

Bird

[11] 4,168,418

[45] Sep. 18, 1979

[54] RENDERING OF MATERIAL SUCH AS MEAT

[76] Inventor: Leslie L. Bird, 5715-3E E. Rosedale, Ft. Worth, Tex. 76112

[21] Appl. No.: 831,177

[22] Filed: Sep. 7, 1977

[51] Int. Cl.[2] ..... H05B 9/06

[52] U.S. Cl. ..... 219/10.55 A; 34/1; 210/69; 219/10.55 F; 426/417

[58] Field of Search ..... 219/10.55 R, 10.55 A, 219/10.55 M, 10.55 F, 10.55 E, 10.81; 34/1, 4; 210/69, 175–187; 426/417

[56] References Cited

U.S. PATENT DOCUMENTS

| | | | |
|---|---|---|---|
| 3,078,287 | 2/1963 | Downing | 426/417 X |
| 3,532,511 | 10/1970 | Binkerd et al. | 219/10.55 M |
| 3,614,365 | 10/1971 | Lane | 219/10.55 A |
| 3,748,421 | 7/1973 | Peterson | 219/10.55 A |
| 3,858,022 | 12/1974 | Smith | 219/10.55 A |
| 3,961,568 | 6/1976 | Jeppson | 219/10.55 A X |
| 4,045,879 | 9/1977 | Witte | 426/417 X |
| 4,050,162 | 9/1977 | Candor | 34/1 |

*Primary Examiner*—Arthur T. Grimley
*Attorney, Agent, or Firm*—Wofford, Fails & Zobal

[57] ABSTRACT

Apparatus for rendering material like edible and inedible meat products and blood characterized by a cabinet having at least one and preferably a plurality of elongate paths for traversal of material longitudinally thereof, an endless perforate belt traversing over rollers and along the elongate path for carrying the material therealong in moving bed fashion; the cabinet having walls surrounding the path formed of material that reflects microwave energy and the belt including at least a portion of a material that reflects the microwave energy and coacting with the walls to reflect microwave energy such that multiple passes of the microwave energy through the material is effected for more efficient use. A plurality of microwave energy input stations are employed with the microwave input wave guides being inclined at respective critical angles so as to effect repeated passes of the microwave energy through the material; particularly acute angles $\theta$ and obtuse angles $\beta$ to obtain more intense rendering over at least one region between the oppositely directed microwave inputs. Respective material inlets, drain means for fat and water, water vapor removal and discharge means for discharging the rendered product exteriorly of the cabinets are also included. Also disclosed is the method employing the apparatus.

24 Claims, 11 Drawing Figures

RENDERING OF MATERIAL SUCH AS MEAT

BACKGROUND OF THE INVENTION

1. Field of the Invention

This invention relates to the heating of material by use of microwave energy. More particularly, this invention relates to rendering a material like meat products and blood by the use of microwave energy.

2. Description of the Prior Art

The prior art has seen the development of many types of apparatus for heating materials and has seen the development of many types of processes for rendering of meat products and the like. There have even been numerous patents on the use of microwave energy in the precooking of food products and the like. Typical are the following U.S. Pat. Nos.: 3,321,314; 3,614,365; and 3,961,568 describe the use of microwave energy for precooking meats such as bacon. Other patents such as U.S. Pat. Nos. 3,805,009; 3,881,403; 3,908,029; 3,872,603; and 3,916,136 describe apparatus for the use of microwave energy for cooking materials such as donuts, causing bread to rise, drying moist pasta, drying moisture laden materials and employing standing waves in a cavity with quartz rollers and the like. Others such as U.S. Pat. Nos. 3,725,628 and 3,885,118 describe technical apparatus with energy suppression means to lower the energy loss of the microwave energy during use of the apparatus.

From the foregoing, it can be seen that this art has become crowded. Despite the crowded nature, there has not been a totally satisfactory and efficient method and apparatus for employing microwave energy for rendering or other processes in which the material possesses a large amount of water. Apparently the separated water interfered with the efficiency of the microwave energy. Also, the microwave energy in standing wave fashion has created intense hot spots in large chambers or the like. Because of the inefficiencies and disadvantages of the prior art methods and apparatus, other heating steps, such as with steam, were incorporated into the processes to try to keep down the cost; and it was considered infeasible to use only microwave energy for large scale processes, such as rendering.

SUMMARY OF THE INVENTION

Accordingly, it is an object of this invention to provide method and apparatus that can be employed to utilize microwave energy efficiently in heretofore uneconomic processes such as rendering of material like edible and inedible meat products and blood; while alleviating the difficulties and deficiencies of the prior art.

More particularly, it is an object of this invention to provide method and apparatus that efficiently uses microwave energy for rendering of material containing water in relatively thin moving beds while alleviating the difficulties and deficiencies of the prior art.

These and other objects will become apparent from the descriptive matter hereinafter, particularly when taken in conjunction with the appended drawings.

In accordance with this invention, there is provided apparatus for rendering material like edible and inedible meat products and blood comprising:

a. a cabinet having at least one elongate path for traverse of material longitudinally therealong; the cabinet having walls surrounding the path and formed of a material that reflects microwave energy;

b. an endless belt disposed within the cabinet and transversing along the elongate path for carrying the material therealong in moving bed fashion, the bed being relatively thin. The endless belt is perforate with sufficient apertures of sufficient size to drain off fat, water, and the like that is rendered from the material. In one embodiment, the apertures in the belt are too small, however, to pass microwave energy and effect reflection thereof. The belt has at least a portion that is formed of a material that will reflect the microwave energy and co-acts with the walls to effect reflection of the microwave energy for a plurality of passes through the material being rendered. The apparatus also includes roller means that are disposed at the respective first and second locations at the extremities of the belt travel to support the endless belt; and a plurality of microwave energy input means adapted for directing microwave energy of a predetermined frequency into the material being moved along the path via the belt. The microwave energy input means are inclined at respective angles with respect to longitudinal axis of the paths so as to effect reflection of the microwave energy through the material a plurality of times for more efficient use of the microwave energy; at least one of the microwave energy input means is inclined at a critical acute angle $\phi$ and at least one is inclined at a critical obtuse angle $\beta$ such that the two oppose, or point toward, each other over a region to obtain more intense rendering in that region. The apparatus also has material inlet means adjacent the upstream end of the top surface of the belt for facilitating feeding of the material on the belt; and a first drain means for draining off fat and the like rendered from the material. The first main drain means is disposed beneath at least the top surface of the belt; and, preferably, below the belt; and is connected exteriorly of the cabinet for conducting the molten fat to a receptacle or the like. The apparatus includes water removal means connected in communication with the belt and connected exteriorly of the cabinet; and discharge means for discharing the rendered product exteriorly of the cabinet. The water removal means is adapted for removal of liquid water, alone or with the rendered fat, and for removal of water vapor.

In another embodiment of this invention, there is provided a method of rendering the material comprising a plurality of steps. Material is passed in moving bed fashion in a relatively thin bed along predetermined path defined by walls and/or belt that reflect microwave energy; the passing being effected by way of a belt having apertures therein for draining off fat and water rendered from the material. The material is irradiated with primary and reflected microwave energy that is reflected through the material a plurality of times by the walls and the belt to render the material. The irradiation is by way of acutely and obtusely angled microwave energy input means, the angles being selected to effect multiple passes of the microwave energy through the material when reflected by the walls and the belt. The fat that is rendered from the material is passed through the apertures in the belt and collected. The water that is rendered from the material, alone or in admixture with the fat, may be also collected. The water vapor is removed from the cabinet to make more efficient use of the microwave energy.

DESCRIPTION OF PREFERRED EMBODIMENT(S)

A large number of patents have been issued in the field of cooking food products with microwave energy. These patents usually point out the rapid cooking that is able to be achieved by the microwave energy penetrating and generating heat throughout the interior regions of the product, instead of relying on surface heat and slow conduction. Such patents point out, however, that the distribution and heat causes some difficulties if taste is to be involved and admit that the microwave heating has not been economically practical because of the equipment costs, dissipated power, interference with water vapor and failure to use all of the energy in the supplied microwaves. Heretofore, as in U.S. Pat. No. 3,961,568, the approach has been to try to vary a process rather than improve the equipment, per se. In such variations of processes, there was sequentially staged heating and drying portions with steam stages to reduce the amount of expensive microwave heating.

The apparatus enabling carrying out the method of this invention will now be described in more detail referring particularly to FIGS. 1 and 2.

Figure 3:
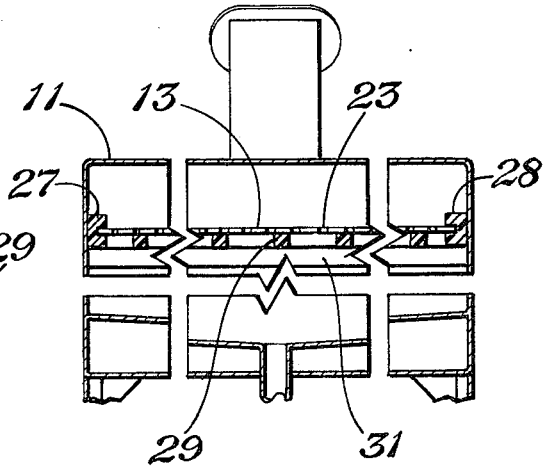
FIG. 3 is a partial cross-sectional view showing one elongate pathway with one embodiment of a reflective belt and its runners.
Figure 4:
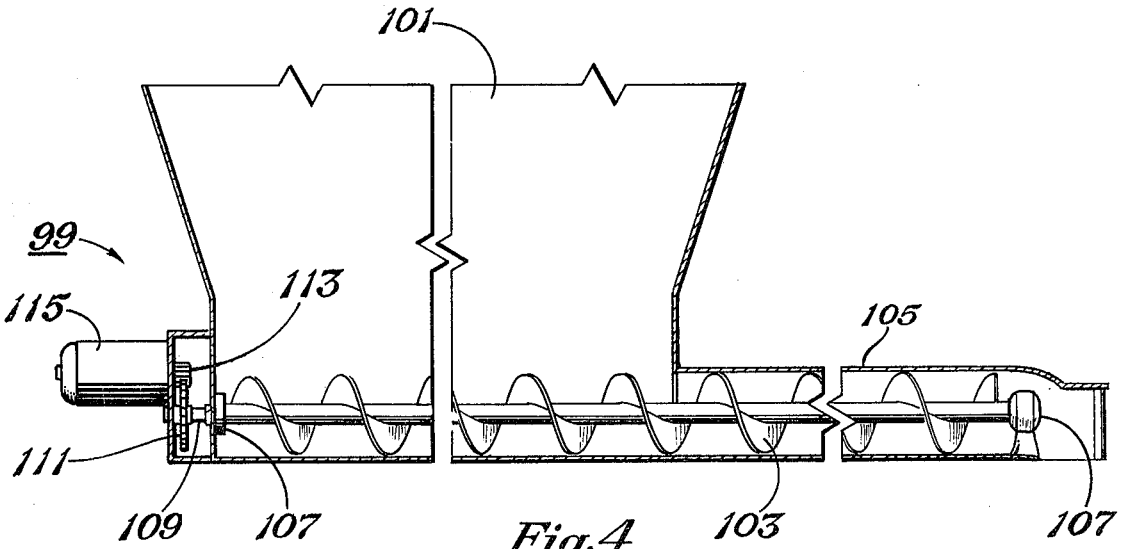
FIG. 4 is a partial plan view of a feed apparatus for the apparatus of FIG. 1.

A cabinet 11 is formed about at least one elongate path for transverse of the material longitudinally therealong. The cabinet 11 has walls that, in combination with a belt 13, surround the path and are formed of a material that reflects the microwave energy. Any of the suitable materials that reflect microwave energy and have adequate structural strength can be employed. I have found it particularly advantageous to employ stainless steel, since it can be cleaned so readily and is impervious to chemical attacks. If desired, the cabinet may completely surround the path on all four sides. As will become apparent from the descriptive matter hereinafter, in one embodiment of this invention, it is only necessary that the cabinet 11 surround three sides of the path, as illustrated in FIG. 3, since the illustrated endless belt 13 is also reflective of the microwave energy.

An endless belt 13 is disposed within the cabinet 11 and traverses along the elongate path for carrying the material therealong in moving bed fashion. The belt 13 is supported by suitable rollers, or pulleys, 15 and 17. As illustrated in FIG. 1, only the right pulley 17 is a driving pulley for moving the belt. Pulley 15 is an idler pulley. More positive movement can be achieved with both being drive pulleys. This allows loading the belt more heavily with material that is to be rendered. Also as illustrated, the pulleys turn clockwise in FIG. 1 to impart a direction of motion in the direction of the arrows 19 for the material. Thus, the belt 13 and the material move through the elongate path 21 formed by the cabinet 11 and belt 13. The belt 13 is supported with a flat horizontal upper portion of the belt extending through the one or more passageways that it traverses along. The belt is perforated with sufficient apertures of sufficient size to drain off fat, water and the like that is rendered from the material. The apertures in the belt are too small, however, to pass microwave energy. Specifically, the belt 13 has holes less than the critical diameter, namely $\frac{1}{4}$ wave length; that allows escape of the microwave energy and coacts with the upper portion of the pathway walls in cabinet 11 to form a reflective path that continuously reflects the microwave energy a plurality of times through the material being rendered until all of the microwave energy has been used up for utmost efficiency, referred to as having "a balanced load". As illustrated, the perforate belt 13 is foraminous with a plurality of uniformly spaced apertures of about $\frac{1}{8}$–$\frac{1}{4}$ inch diameter. The apertures may range from 1/16 to one inch or so although the larger sizes are objectionable from the standpoint of allowing the material to fall throughout the apertures. As will become apparent from other embodiments discussed hereinafter, the perforate belt may comprise joined sections with discontinuities between the joints to serve as the perforate portion that allows draining off of water, fat and the like. Whereas the belts in the prior art were formed of electrically non conductive material to avoid interference with the desired microwave heating, this invention provides a belt that has at least a portion formed of an electrically conductive material, such as metal, that will reflect the microwave energy back through the product. The bottom reflection may be via the belt 13 alone, or in coaction with a reflective bottom wall of a cabinet, the latter being described later hereinafter.

Figure 1:
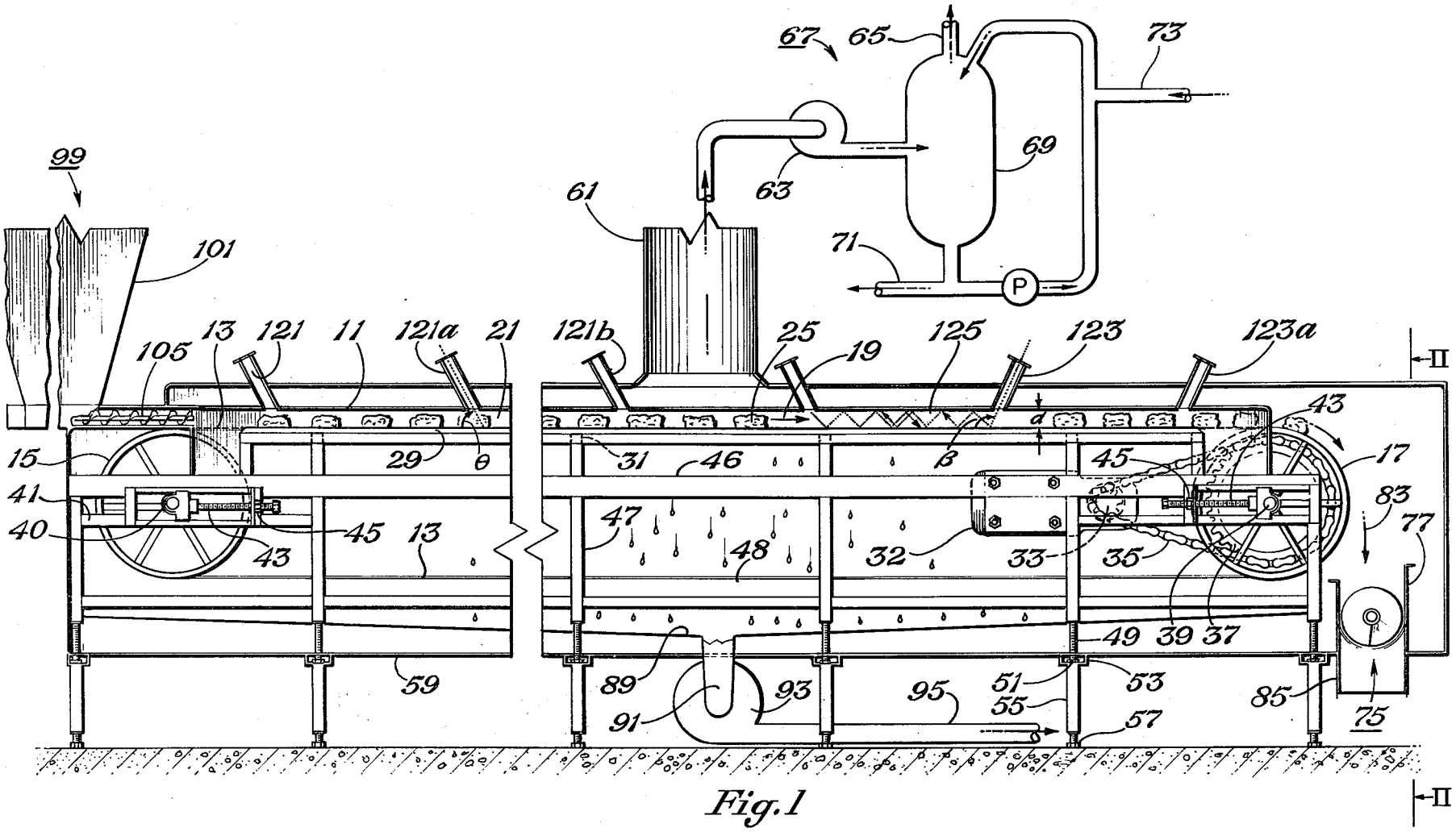
FIG. 1 is a partial side elevational view, partly in section and partly schematic, showing rendering apparatus in accordance with an embodiment of this invention.
Figure 5:
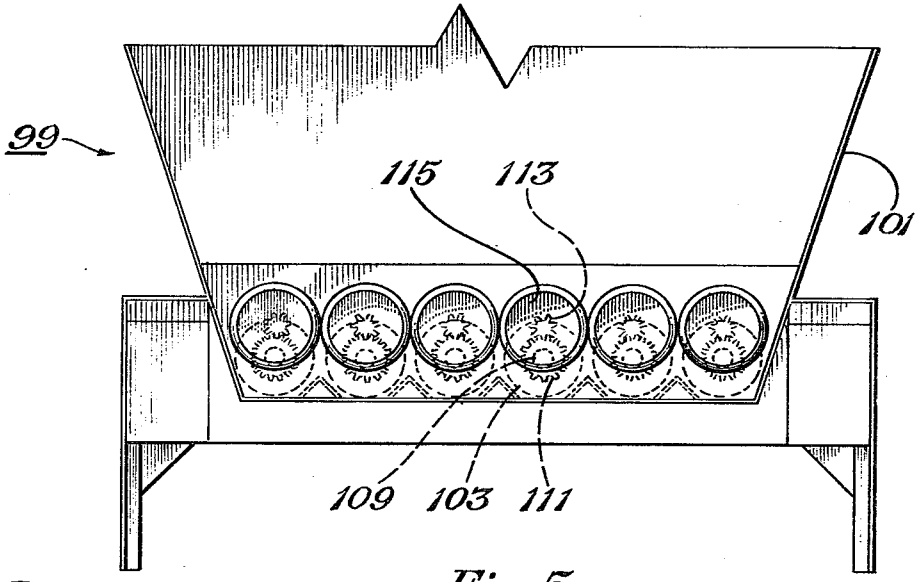
FIG. 5 is a rear view of the feed apparatus of FIG. 4.
Figure 1A:
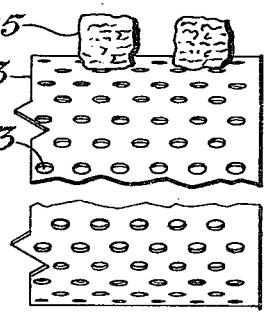
FIG. 1*a* is a partial plan view of the belt of FIG. 1.

As can be seen more clearly from FIG. 1*a*, the conveyor belt 13 of FIG. 1 is formed of stainless steel and the apertures 23 that are formed therein to get the foraminous condition allow rendered fat and water to be immediately drained away from the product 25, such as meat, carried on the belt.

Since the belt is formed of conductive material, it is preferred that it traverse along nonconductive runners. Such runners are illustrated in FIG. 3 by the side slotted carriers 27, 28 and the longitudinally extending runners 20. These runners are preferably formed of a material having a low coefficient of friction so as to obviate the requirement for using ball bearings or the like. Typically, the runners may be formed of thermoplastic material; such as, Nylon, Delrin, the polyflorcarbons like Teflon, or other thermoplastic material having low coefficient of friction and yet having adequate structural strength. As illustrated, the runners 29 are supported by metallic structural cross members 31.

The belt is moved by the driven pulley 17 responsive to drive means. Any of the conventional drive means may be employed. As illustrated, it includes a drive 31, such as an electric motor with suitable gear reducers terminating in a sprocket 33, and an endless loop such as chain 35 connected with the sprocket 37; that is, in turn, drivingly connected with, as by welding, the pulley 17. The pulleys are journalled for rotation via their respective shafts 39, 40. The shafts may be moved longitudinally of the frame 41 by way of adjusting screws 43 to obtain the desired tension in the belt 13. The adjusting screws 43 are, of course, passed through suitable base members 45 against which the tensioning force can be applied. For example, the base members 45 may have suitable nuts welded thereonto for engaging the threads on the adjusting screws 43.

The entire upper structural frame 41, including the plurality of stanchions 47 and the longitudinal structural members 46, 48, as well as the cross members 31, and, consequently, the belt 13 and the sprockets 15 and 17, can be raised and lowered in height to tune the pathway 21 to the optimum depth d for the microwave energy being employed. Specifically, the stanchions 47 include at their lower end, an adjustable threaded shaft 49 that is screwed through a nut 51. The nut 51 is carried in suitable bracket 53 on the bottom stanchion 55. Each of the bottom stanchions 55 have suitable levelling bases 57. Thus it can be seen that the threaded shaft 49 and the nut 51 will effect raising and lowering of the upper framework 41 when there is relative rotational motion therebetween. Specifically, raising and lowering is effected by turning a bolthead 52, FIG. 2, to rotate the threaded shaft 49 with respect to the nut 51 welded onto the bracket 53.

Figure 2:
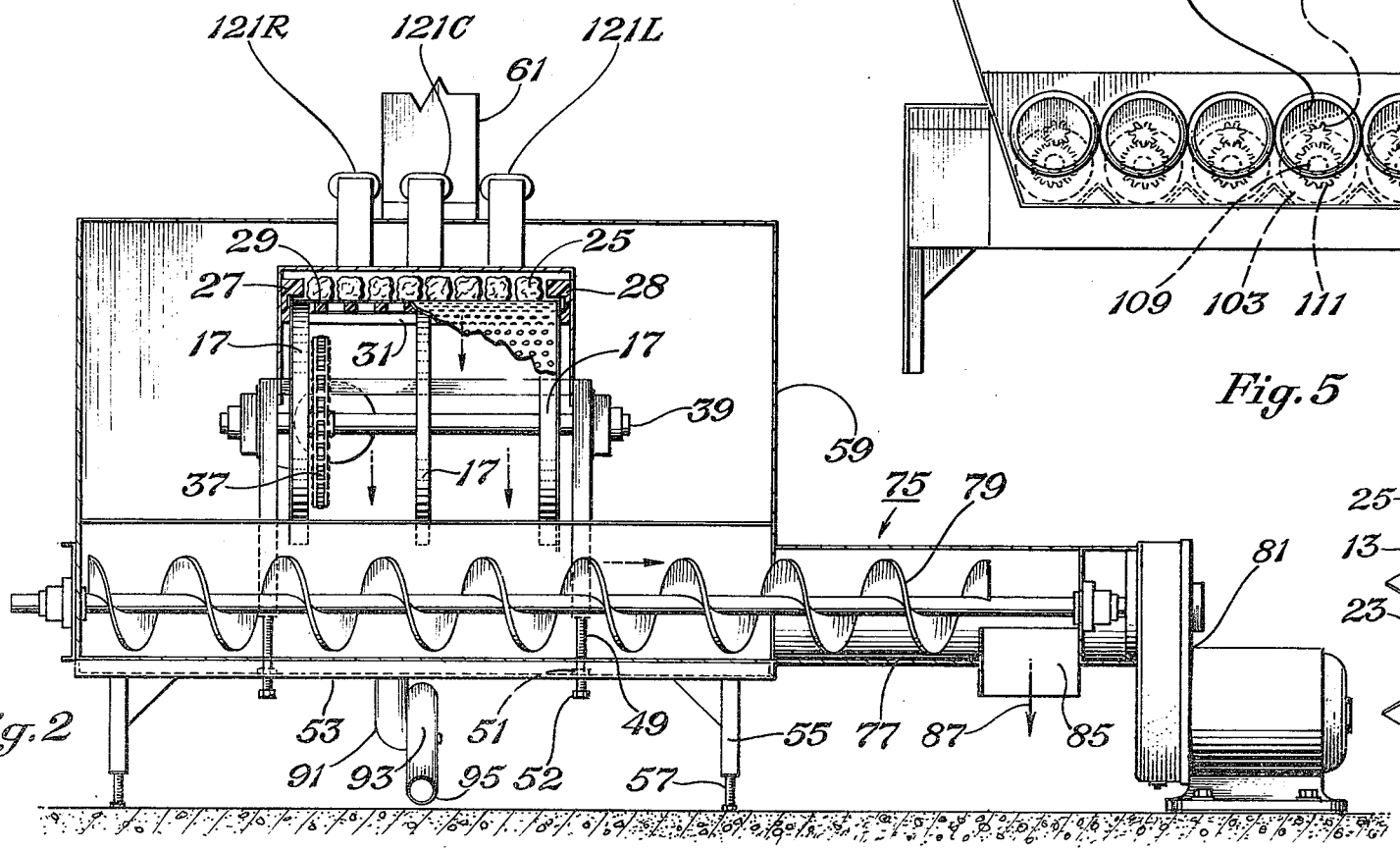
FIG. 2 is a cross-sectional view taken along the lines II—II of FIG. 1 with a portion of the auger trough cut away to show the auger more nearly completely.

Surrounding the cabinet 11 is a vacuum shell 59, FIGS. 1 and 2. The vacuum shell is formed of structurally adequate material to withstand the degree of vacuum that is pulled thereon; for example, up to several millimeters of mercury vacuum. Obviously, it will be unnecessary to pull as much as one atmosphere vacuum but it may be desirable to pull up to $\frac{1}{3}$ to $\frac{1}{2}$ atmosphere; for example, 38–40 centimeters of mercury. This is accomplished by withdrawing water vapor, and the like through a stack 61. The primary purpose is to remove the water vapor that would tend to interfere and render less efficient the microwave energy. As shown schematically in FIG. 1, the stack 61 is connected by way of suitable vacuum pump 63 to a discharge conduit 65. The discharge conduit 65 may be a smoke stack, a stack with a pilot light or the like. If desired, or if employed in a populated area, suitable scrubbing system 67 may be employed for removal of odors or the like. The scrubbing system 67 may comprise a vessel 69 in which a scrubbing fluid such as caustic or an amine, is employed to remove the noxious and odoriferous gases and the like. The spent bottoms may be withdrawn through line 71. Fresh circulating liquid may be added through line 73. The vessel, or scrubber, 69 is conventional and may be filled with raschig rings, beryl saddles, or the like and employ spray nozzles, or employ conventional bubble trays. The latter is ordinarily more elaborate than required, although they are highly efficient. If an amine is employed, triethanol amine is suitable for adsorbing most of the noxious odors and reacting with the noxious gases such as the mercaptans or hydrogen sulfide. Moreover, caustic washes can be employed to accomplish the same result. Such systems are commercially available and need not be described in great detail herein. Obviously such systems add to the expense of an installation and will not be employed unless necessary to meet pollution emission requirements.

The vacuum shell 59 also encompasses a discharge means 75. The discharge means 75 comprises a trough 77, FIGS. 1 and 2 and, disposed therewithin, an auger 79. The auger 79 is driven by suitable drive, such as motor drive 81. Thus, as the meat products fall, symbolized by arrow 83, into the trough 77, the driven auger 79 takes them laterally to the discharge spout 85 where they can be discharged as shown by arrow 87. The spout 85 also is the entry point for air that is sucked through the vacuum shell 59 to scavenge the water vapor therefrom and minimize intereference with the microwave energy. Thus the product that has been rendered so as to be in a relatively dry state, such as the meat that can be employed in dog or cat food, will be removed by way of the discharge spout 85.

The fat and water that is rendered from the product is removed, however, by way of one or more suitable drain pans, such as drain pan 89 disposed beneath the entire belt assembly so as to catch all of the drippings therefrom. Because of the vacuum, the pan 89 is connected exteriorly by way of conduit 91 to a flow means for overcoming the vacuum. The flow means may take the form of a head of liquid or the like. As illustrated, however, it is shown as a pump 93. The pump 93 has its discharge conduit 95 available to fill suitable containers or to be sent through a process where the respective ingredients such as fat and water may be separated and treated. If desired, a plurality of pans may be employed with each of them being connected exteriorly to flow means to fill suitable containers. The reasons for employing a plurality of pans is because at the different stages along the pathway the respective ingredients such as the fat, water and the like has differing degrees of purity and odorousness. In fact, some of the tallow that is formed is in such a pure state with the microwave energy that it can be employed alomost verbatim with very little further processing. On the other hand, in conventional processes, there are disagreeable odors aand colors that have to be removed.

Figure 6:
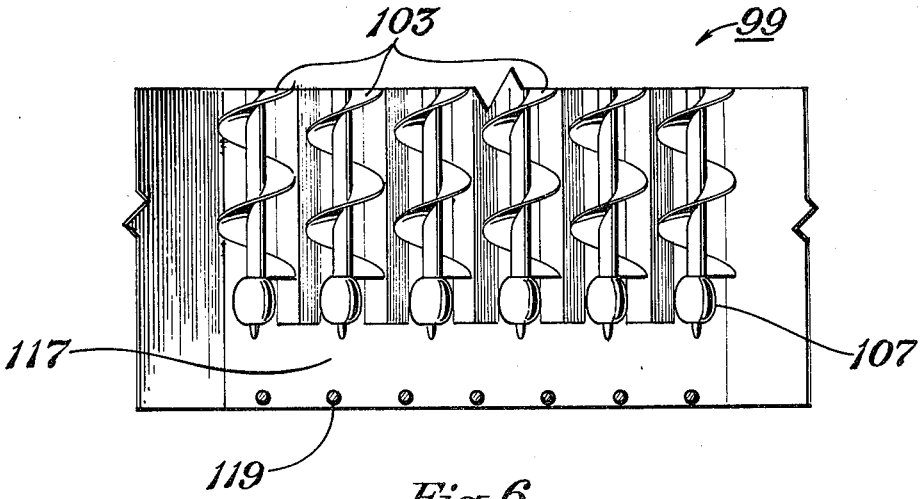
FIG. 6 is a partial plan view of the discharge end of the feed apparatus of FIG. 4.
Figure 7:
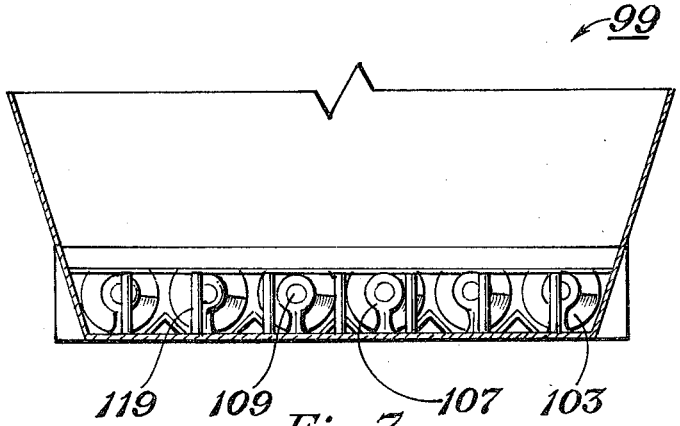
FIG. 7 is a partial end view of the discharge end of the apparatus of FIG. 4.

To put into the vacuum shell 59, cabinet 11 and onto the belt 13, the material to be rendered, there is provided feeder means 99. The feeder means 99, FIGS. 1 and 4–7, includes a large hopper 101 for receiving major portions of the product to be rendered; for example, $\frac{3}{4}$ inch ground offal and members of carcasses of dead animals or the like. The hopper is formed of a material such as steel that has adequate structural strength. At the bottom of the hopper 101 there are a plurality of extruders 103 for carrying the product along the extrusion chute 105 into the cabinet 11. The extruders 103 are in the form of augers that are journalled for rotation, as suitable bearing mounts 107 at each end. They are driven by way of shaft 109 having a gear or sprocket 111 mounted on the driven end. Torque and rotational power is supplied by way of drive gear 113 rotated by motor 115. If desired, suitable sprockets and a single driven chain may be employed to drive all of the augers, or extruders, 103 simultaneously. In any event, they are rotated so as to move the particles of product, such as meat, in large chunks of up to 2–5 inches in maximum dimensions into the cabinet 11 and onto the belt 13. As can be seen in FIG. 6, the extruders 103 discharge the meat from their respective chutes into a main chamber 117 after which it is extruded past vertical pins 119 to ensure that these maximum dimensions are maintained for most efficient rendering.

At the heart of this invention and coacting with the reflecting belt and cabinet are microwave energy input means, including wave guides, that put in the microwave energy at critical angles for most efficient use of the energy therewithin. Specifically, there are a plurality of microwave energy input means 121 and 123, FIG. 1. As illustrated in FIG. 1, the microwave energy input means 121 are inclined at a respective critical acute angle $\theta$ with respect to the longitudinal axis of the path 21 so as to effect reflection of the microwave energy through the material to be rendered a plurality of times for most efficient use of the microwave energy. Also, as illustrated, the microwave energy input means 123 are inclined at a critical obtuse angle $\beta$. The angle $\theta$ must be between the angles of 30°–60° to obtain optimum reflectivity of the input energy. For example, it has been found that an angle of about 45° will be adequate. The angle $\beta$, on the other hand must be in the range of from about 120°–150°; with the optimum being about 135° for the apparatus illustrated. By the use of the opposing angles, at least one region 125 is created in which there is intense rendering by reflected microwave energy from both directions, or from both input means 121 and 123. Thus, in effect, the path formed between the belt 13 and the walls of the cabinet 11 is a heating tunnel in which the microwave energy is reflected back and forth through the material being rendered. Side slotted carriers 27, 28, prevent the product from being emplaced immediately adjacent the walls of the cabinet 11 where heating is less effective. Moreover, the carriers 27 and 28 are formed of electrically non conductive material to avoid interference with the microwave field and keep down difficulties with static electricity.

As indicated, the microwave energy is injected, preferably, at a plurality of longitudinal locations such as 121*a*, 121*b* and 123[a, as well as the locations 121 and 123. Each of the injection wave guides may be disposed at a plurality of lateral locations at each longitudinal location; for example, three across (FIG. 2) and illustrated respectively as 121R, 121C and 121L for the respective right, center and left when viewed from the direction from which they are slanted. The microwave energy that is injected at the respective acute and obtuse angles is repeatedly reflected between the belt and the top of the housing and thus repeatedly passed through the material on the conveyor belt. As the microwave energy is weakened going from a first location, it is enhanced by the injection of the microwave energy at a second location, at a third location, and so on. As the microwave energy is passed through the material, heat is generated throughout the material and the rendering is very rapid. Moreover, the fat and moisture in the product is driven to the surface to run off rapidly and does not have to have total amount of energy put into the product to vaporize the water.

The microwave energy that is employed may comprise any of the conventionally available frequencies having suitable power output. Although these frequencies may range from about 300 megahertz (MHz) to as much as 10,000 MHz, the standard operational frequency will be in the range of 2450 MHz to 915 MHz. Any of the conventional designs of the microwave units may be employed. Typically the units have a power output of about 500–5000; for example, about 1000; watts each. The units are stacked as desired. For example, enought units can be employed to obtain a power input in the range of 180–500 kilowatts to allow rendering from 3000 to 10,000 pounds per hour of material. Magnetrons up to 6 kilowatts each may be employed, if desired.

In operation, the material, such as meat, is fed into hopper 99, extruded through the extrusion chute 105 and on to the belt 13 within the cabinet 11. Microwave energy is input through the wave guides from conventional microwave units 121 and 123. The microwave energy is reflected back and forth between the walls and the belt, similarly as shown by the arrows in the region 125. In the region 125, there is double passage from both directions of the microwave energy to create intense local heating and rendering.

The belt and its respective idler pulleys may be raised and lowered by adjustment of the bolthead 52 to optimize the reflectivity. The respective angle $\theta$ may be about 45° and the obtuse angle $\beta$ may be about 135° to obtain the desired reflectivity in coaction with the proper height, or depth d between the belt and the top inner reflecting wall of cabinet 11. In any event, there is a multiple passage of the microwave energy through the product causing the water to migrate to the surface and be removed; and also causing the fat to be rendered from the material. The water and fat pass off, as through the apertures 23 of the stainless steel belt 13 and fall into the drain pan 89 which underlies the entire belt and path. The respective rendered fat and water products are removed, as by pump 93, to suitable containers for the further separation and treatment processes, as desired. The product, or material, from which the fat has been rendered is also removed by way of the discharge means 75 and can be further processed, as into bone meal, pet food, fertilizer, or the like. During the operation, the vacuum pump 63 maintains the vacuum shell 59 and the cabinet 11, including path 21, under vacuum with the air being sucked therethrough to withdraw water vapors, noxious gases and the like.

The products that have been produced by this apparatus have been found to be superior. In certain instances, drier product is desired. In such instances, the reflective belt may be overlaid by suitable overlays, or apparatus, that is not reflective or electrically conductive to move the product away from the belt a short distance; for about a centimeter or so. Much drier product is obtained with the same length of run and the same power input. Suitable overlays may be formed as described hereinafter with respect to FIGS. 8–10 or by simply overlying the stainless steel belt with a perforate thermoplastic structure, such as of Neoprene, asbestos or the like.

It should be emphasized that the apparatus of this invention will be designed to handle extremly large quantities of material; for example, up to 80,000 tons per day of dead animal carcasses or the like. Accordingly, it is imperative that the materials be structurally strong enough to withstand the strain and resist wear of such large quantities of material, such as meat and bones, blood and the like. Each of the microwave input units 121 and 123 may be of any power output, depending upon requirements and availability of equipment. The power for the units may be supplied by magnetrons, klystrons, or available equipment. Preferably, a plurlality of such magnetrons of about 6000 watts each are employed such that flexibility is maintained even if there is a failure of one unit. Preferably, power is supplied in levels of about 4000 volts or the like to obtain the necessary power input without unduly high flow of current. Of course, the particulars of the power units and the microwave units may be varied as commercially improved units become available.

The materials in the cabinet and the vacuum shell, drain pan and the like are preferably formed of readily cleanable material such as stainless steel.

OTHER EMBODIMENT

Figure 8:
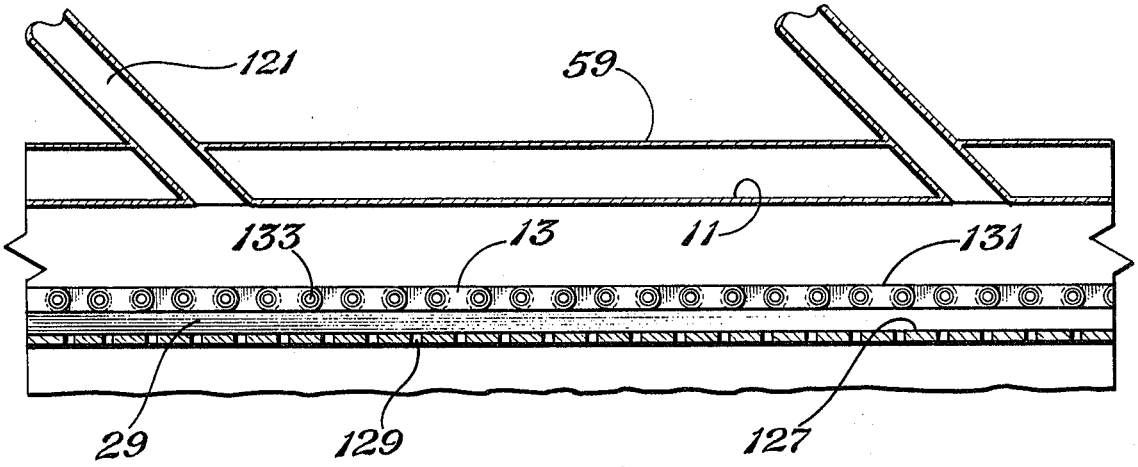
FIG. 8 is a partial cross-sectional view taken longitudinally of an embodiment of this invention showing another embodiment of a belt and pathway effecting kaleidoscopically changing reflections of the microwave energy.
Figure 9:
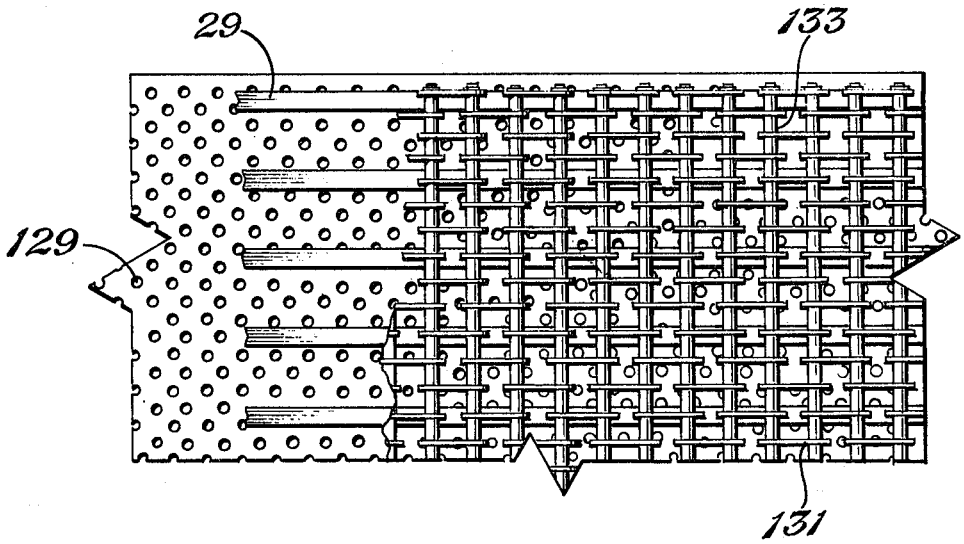
FIG. 9 is a partial top plan view of the belt and bottom of FIG. 8.
Figure 10:
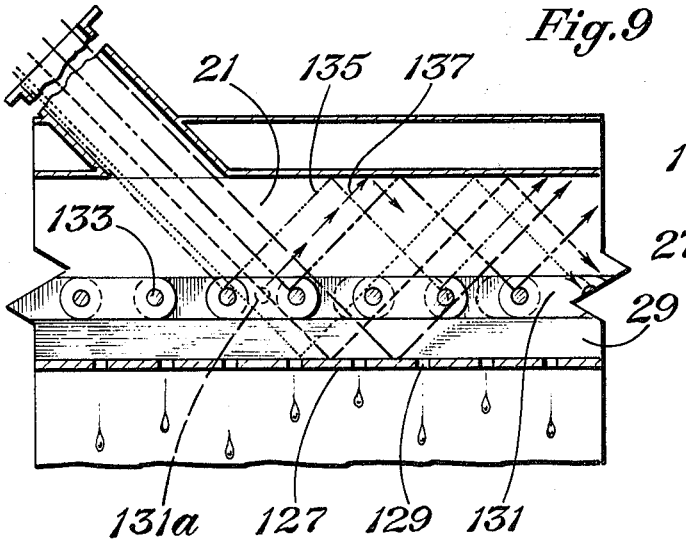
FIG. 10 is a partial elevational view, partly in section, illustrating the kaleidoscopically varying reflective pattern of the microwave energy effected by the apparatus of FIG. 8.

If desired, other embodiments of the unit may be employed such as illustrated by the partial cross sectional view of FIG. 8. Specifically, therein the cabinet 11 is imposed within the vacuum shell 59 similarly as illustrated and described with respect to FIG. 1. In this embodiment, however, the cabinet 11 has a reflective bottom 127 that has a plurality of drain apertures 129 therein. Similarly, as described hereinbefore with respect to the apertures 23 and the belt 13, the apertures 129 are small enough to allow the draining off of the water and fat that are rendered from the product, but not to allow the escape of the microwave energy. The belt 13 is pulled along runners 29 similarly as described hereinbefore and carried by suitable driving and idling pullers (not shown). As can be seen in FIGS. 9 and 10, however, the belt is comprised of a plurality of segments 131 that are interlaced and held together by rods 133. The segments 131 are preferably formed of electrically non conductive material such as asbestos, fiber glass, Neoprene or thermoplastic material. The rods 133 are preferably formed of the electrically conductive material such as stainless steel, or other non corroding metal. The bottom, or bottom wall, 127 is formed of a material, such as metal that will reflect the microwave energy. Preferably, the bottom wall 127 is formed of stainless steel or other easily cleanable material.

The segments 131 are interleaved so as to interdigitate together and allow the necessary flexibility to be moved around their respective pulleys. The interleaving may be effected by suitable apertures by which the rod 133 penetrates. The rods have their respective ends bradded or bent so as to prevent unwanted disassembly, or falling off of the respective segments 131. The distance between the rods will be less than the reflective distance of the microwave energy, for example, the rods may be spaced closer than 2 inches (5 centimeters) together, as by about 1.2 inches (3 centimeters). This distance may vary as different frequency microwave energy is employed. The structure of FIGS. 8–10 is advantageous in that the product is held above the reflecting surfaces, such as the rods 133 and the bottom 127 by varying distances to obtain different degrees of heating. Moreover, as the belt is pulled along the runners 29, there is a kaleidoscopic effect, such as illustrated in FIG. 10 in that the microwave energy is reflected at different points at different angles and impinges on different spaces, traveling through different volumes. For example, the reflection pattern is shown by arrows 135 at one instant, whereas, at a later instant, the rods will move into position shown in the dashed line 131*a*, the reflection pattern will change to be as shown in the dashed lines 137. Thus, the rods 133 form a mobile or shifting pattern that is ever changing as the belt is moved along the path 21. This varies from the set and unchanging patterns of the prior art. Consequently, there is a more nearly uniform heating of the material as it is moved along the path 21. The varying wave patterns, or kaleidoscopically varying reflection patterns, afford a more nearly perfect heating of the material and more efficiently uses the microwave energy in rendering the material along the path. The individual segments 131 hold the product above the reflecting rod or bottom so as to get a more intense heating and make more efficient use of the microwave energy, particularly where a dried effluent product at the distance means 75 can be tolerated. Moreover, in certain applications an exceptionally dry product is desired so that the segmental belt is much preferred.

The operation of the apparatus of FIGS. 8–10 is essentially the same as described hereinbefore. It is preferably encompassed within the vacuum shell 59, as noted, and has the product fed thereinto by way of feeder 99 and discharged by way of discharge means 75.

In the embodiments described hereinbefore, suitable monitoring and safety procedures and equipment will be employed as required in the use of microwave energy to prevent endangering the health of the employees. Whereas vacuum operation has been described hereinbefore, the apparatus of this invention will be employed at atmospheric pressure with gaseous flushing away of water vapor where ever possible.

From the foregoing, it can be seen that this invention accomplishes the objects delineated hereinbefore.

Although the invention has been described with a certain degree of particularity, it is understood that the present disclosure is made only by way of example and that numerous changes in the details of construction and the combination and arrangement of parts may be resorted to without departing from the spirit and the scope of the invention.

What is claimed is:

1. Apparatus for rendering material like edible and inedible meat products and blood comprising:

a. a cabinet having at least one elongate path for traverse of said material longitudinally thereof; said cabinet having walls that together with a belt surround said path and that are formed of material that reflects microwave energy;

b. an endless belt with at least a cooking surface disposed within said cabinet and traversing said elongate path for carrying said material therealong in moving bed fashion; said endless belt including at least a portion that will reflect microwave energy and having perforate openings sufficient and operable to drain off water, fat and the like rendered from said material; said belt co-acting with said walls of said cabinet to reflect said microwave energy through said material a plurality of times for efficient use thereof;

c. roller means disposed at respective first and second locations at the extremities of said belt travel for supporting said endless belt; said roller means having at least one power means for driving said belt;

d. a plurality of microwave energy input means adapted for directing microwave energy of a predetermined frequency into said material along said path on said belt; said microwave energy input means being inclined at respective angles with respect to the longitudinal axis of said path so as to effect reflection of said microwave energy through said material a plurality of times for efficient use of said microwave energy; at least one of said microwave energy input means being inclined at a critical acute angle $\theta$ and at least one of said microwave energy input means being inclined at a critical obtuse angle $\beta$ over at least one region to obtain intense rendering therein;

e. material inlet adjacent the upstream end of the top surface of said belt for facilitating entry of said material onto said belt;

f. first drain means for draining off fat and other liquid rendered from said material; said first drain means being disposed beneath said top surface of said belt and connected exteriorly of said cabinet;

g. water removal means connected in communication with said belt and connected exteriorly of said cabinet; said water removal means being adapted for removal of at least water vapor; and h. discharge means for discharging the rendered product exteriorly of said cabinet.

2. The apparatus of claim 1 wherein said endless belt is perforate with sufficient openings of sufficient size so as to drain off water, fat and the like as said material is rendered; said openings being too small to pass microwave energy and effecting reflection thereof; said belt being formed of a material that will reflect said microwave energy.

3. The apparatus of claim 2 wherein said endless belt comprises metal and has apertures of a diameter within the range of 1/16–1 inch.

4. The apparatus of claim 3 wherein said endless belt is stainless steel.

5. The apparatus of claim 4 wherein said stainless steel belt has apertures in the range of about $\frac{1}{8}$–$\frac{1}{4}$ inch, inclusive.

6. The apparatus of claim 4 wherein said stainless steel belt runs in and on thermoplastic runners.

7. The apparatus of claim 1 wherein said endless belt comprises a plurality of electrically non conductive segments that are joined together by electrically conductive rods and traverse a plurality of electrically non conductive runners disposed above a reflective bottom wall of said cabinet such that said moving belt, in combination with said bottom wall of said cabinet, effects a kaleidoscopically varying pattern of reflection of microwave energy through said material in operation.

8. The apparatus of claim 7 wherein said segments are formed of thermoplastic segments and said rods are stainless steel rods with said plurality of segments being disposed longitudinally interdigitating with said rods in respective apertures in the respective ends of the segments to maintain the interdigitating segments connected together at their respective ends.

9. The apparatus of claim 1 wherein said cabinet comprises metal walls for reflecting the microwave energy interiorly along said path.

10. The apparatus of claim 1 wherein said microwave energy is of a frequency greater then 300 mega Hertz (MHz).

11. The apparatus of claim 10 wherein said microwave energy is of a frequency within the range of 900–2500 MHz.

12. The apparatus of claim 1 wherein said apparatus includes a plurality of microwave energy input means oriented at said angle $\theta$.

13. The apparatus of claim 12 wherein said apparatus includes a plurality of said microwave energy input means oriented at said angle $\beta$.

14. The apparatus of claim 1 wherein said apparatus includes a plurality of microwave energy input means oriented at said angle $\beta$.

15. The apparatus of claim 1 wherein said first drain means comprises a fat drain pan and conduit connected with said fat drain pan and extending exteriorly of said cabinets so as to drain the rendered fat to an exterior collector.

16. The apparatus of claim 1 wherein said water removal means comprises one drain pan for draining off water and fat and conduit connected with said drain pan for water and fat and extending exterior of said cabinets so as to drain said water and fat to an exterior collector; and one vapor withdrawal means for withdrawing the water vapor to make more efficient use of the microwave energy.

17. The apparatus of claim 1 wherein said discharge means comprises a conveyor disposed beneath the downstream end of the transverse of said belt and a discharge aperture disposed at the downstream end of said conveyor.

18. The apparatus of claim 1 wherein a vacuum shell completely encompasses and encloses said belt, said rollers, said first drain means and said discharge means.

19. The apparatus of claim 18 wherein said vacuum shell is connected with a means for producing a subatmospheric pressure internally of said cabinet for pulling off water vapors.

20. The apparatus of claim 1 wherein said apparatus is emplaced on a base; the top wall of said cabinet defining said path is supported at a fixed distance above said base; and said endless belt and its said roller means are disposed by way of adjustable height means such that the distance d between the top wall of said cabinet and said belt can be varied to optimize the use of the microwave energy in rendering said material.

21. A method of rendering material like edible and inedible meat products and blood comprising the steps of:

a. passing said material in moving bed fashion along a predetermined path defined by walls that reflect microwave energy, said passing being by way of an endless belt having perforations therein for draining off fats and water rendered from said material; said belt including at least a portion that will reflect microwave energy; said belt coacting with said walls to reflect said microwave energy through said material a plurality of times for efficient use thereof;

b. irradiating said material with primary and reflected microwave energy that is reflected through said material a plurality of times by said walls and said belt to render said material;

c. collecting the fat rendered from said material and passing through said belt;

d. collecting at least a portion of the water rendered from said material in admixture with fats also rendered therefrom;

f. removing water vapor from said path intermediate said reflecting walls and said reflecting belt so as to make more efficient use of said microwave energy; and g. collecting the final rendered product.

22. The method of claim 21 wherein a vacuum shell is provided to surround said walls and belt and has restricted inlet of air; wherein said cabinet is connected with a means for producing subatmospheric pressure; and said water vapor is withdrawn more efficiently.

23. The method of claim 21 wherein said endless belt is stainless steel so as to be totally reflective of said microwave energy and has apertures penetrating therethrough for draining off said fats, liquid water and the like; said apertures being too small to pass microwave energy and thereby causing said belt to reflect the same through said material for a plurality of passes and more efficient use of said microwave energy.

24. The method of claim 21 wherein said material is held above the bottom reflective material of said belt and cabinet by having electrically non-conductive material supporting said material being rendered.

* * * * *